United States Patent [19]

Cooper et al.

[11] 4,209,325

[45] Jun. 24, 1980

[54] DESULPHURATION OF METALS

[75] Inventors: Stephen M. Cooper, Consett; Thomas H. Webster, Knowle, both of England; Helmut Jaunich, Raesfeld, Fed. Rep. of Germany

[73] Assignee: Foseco International Limited, Birmingham, England

[21] Appl. No.: 969,977

[22] Filed: Dec. 15, 1978

[30] Foreign Application Priority Data

Dec. 16, 1977 [GB] United Kingdom ..... 52565/77

[51] Int. Cl.[2] ..... C21C 7/02; C22B 9/10

[52] U.S. Cl. ..... 75/58; 75/53; 75/57; 75/130 R; 75/257

[58] Field of Search ..... 75/53, 57, 58, 257, 75/130 A, 130 R

[56] References Cited

U.S. PATENT DOCUMENTS

| | | | |
|---|---|---|---|
| 2,823,989 | 2/1958 | Deyrup | 75/130 A |
| 2,906,617 | 9/1959 | Wahl | 75/130 A |
| 3,853,540 | 12/1974 | Schlatter | 75/53 |
| 3,998,625 | 12/1976 | Koros | 75/58 |
| 4,097,269 | 6/1978 | Holzgruber | 75/58 |

FOREIGN PATENT DOCUMENTS

| | | | |
|---|---|---|---|
| 764157 | 12/1956 | United Kingdom | 75/53 |
| 1461428 | 1/1977 | United Kingdom | 75/53 |
| 1484258 | 1/1977 | United Kingdom | 75/53 |
| 1484456 | 11/1977 | United Kingdom | 75/53 |

*Primary Examiner*—P. D. Rosenberg

*Attorney, Agent, or Firm*—Cushman, Darby & Cushman

[57] ABSTRACT

Injectable composition for desulphurizing molten ferrous metals, especially iron, comprises alkaline earth metal, preferably magnesium, and sintered mixture of lime and at least one fluxing agent. Magnesium is preferably 8 to 60% of composition and lime preferably is 45 to 95% of the sintered mixture. Fluxing agent is preferably alumina and fluoride. Composition enables rapid and efficient desulphurization and does not give large amounts of slag.

10 Claims, No Drawings

DESULPHURATION OF METALS

This invention relates to the treatment of molten metals, particularly the desulphurisation of molten ferrous metals e.g. iron and steel, and to compositions for use in such treatment.

It has been proposed to desulphurise molten ferrous metals by use of mixtures containing a reactive metallic ingredient such as magnesium and a non-metallic ingredient such as lime. It has been said that, for desulphurising pig iron, superior results may be obtained by injecting, beneath the surface of the molten pig iron, a fluidised particulate mixture of nonoxidising material, e.g. lime, and magnesium-containing reactive material, e.g. magnesium itself, this mixture being formed by in-line mixing of the non-oxidising material and the magnesium-containing material in a conveying line leading to the injection site.

It is has now been appreciated that the known mixtures of the above type have certain disadvantages. Disadvantages of the known mixtures can be reduced or avoided by means of the present invention.

According to the present invention there is provided an injectable composition for desulphurising a molten ferrous metal which comprises an alkaline earth metal, and a sintered mixture of lime and at least one fluxing agent. The alkaline earth metal may be calcium but is preferably magnesium.

According further to the present invention there is provided a method for desulphurising a molten ferrous metal which comprises injecting into the molten metal a composition according to the invention.

The composition may be injected using a gas which is substantially inert to the molten metal and to the composition, for example argon, helium or nitrogen, or using a hydrocarbon gas such as propane or methane.

The fluxing agent in the sintered mixture may be any compound which may be used with lime to form a desulphurising slag for molten ferrous metals. Particularly useful examples are alumina, which may be in the form of ball mill dust, sodium carbonate and alkali metal or alkaline earth metal fluorides. It is preferred that the sintered mixture should contain alumina, preferably at least 5% by weight, and that it should contain a fluoride, preferably at least 10, more preferably at least 15%, by weight. Preferably the sintered mixture contains little or no silica e.g. not more than 2% by weight.

Preferably the sintered mixture contains 45 to 95%, more preferably 45 to 60% by weight of lime. The lime in the compositions of the invention is advantageous over other basic oxides, e.g. magnesium oxide, in that it is more basic and this aids the desulphurisation.

The sintered mixture is preferably made using plant and techniques similar to those used in making Portland cement, a rotary cement-roasting kiln giving a temperature of about 1100° to 1200° C. being suitable. The resulting sintered material may be screened to give a powdery or granular product.

The alkaline earth metal and the sintered mixture may each be in the form of granules. The granules of the sintered mixture preferably do not exceed a size of 2 mm, and more preferably do not exceed 0.8 mm. Most preferably all the granules of the sintered mixture, or a majority of their total weight are of size not exceeding 200 microns and preferably not more than 15% by weight of the sintered mixture is of particles of size 75 microns or less. Granules of the alkaline earth metal are preferably not less than 150 microns in size and preferably do not exceed 2 mm, the most preferred range being 150 to 850 microns. Granules of the metal preferably contain more than 80% by weight of the pure metal.

The alkaline earth metal preferably constitutes 8 to 60% by weight of the composition. A proportion of about 50% gives effective and rapid desulphurisation of blast furnace iron without the reaction being too violent and a proportion of about 10% gives a similar effect in the case of steel. The vigorousness of the reaction depends to some extent on the rate of injection, which in turn is dependent, at least in part, on the type of injection apparatus used. With relatively high injection rates it is preferred to use relatively low alkaline earth metal contents to achieve optimum reaction vigour. The converse is also true.

The composition may be injected at any depth into the molten metal which may be in a ladle; in the case of desulphurising molten blast furnace iron, a depth of 1 to 3 meters, most preferably 1.5 to 2.5 meters is especially effective.

The amount of the composition to be injected will depend on its alkaline earth metal content, the initial sulphur content of molten metal and the final sulphur content desired to be achieved. An amount containing for example 0.20 to 0.35 kg. of magnesium may be used to treat each tonne of molten iron to reduce the sulphur by 70% or more, e.g. by up to 91%, from an initial level of about 0.03% e.g. 0.025 to 0.035%. It is preferred to reduce the rate of addition of the composition as the reaction proceeds and the sulphur level decreases so as to avoid wastage of magnesium or other metal. The initial flow rate of the composition into the molten metal will depend on the level of sulphur initially present. The injection time is preferably 0.07 minutes or less per tonne of ferrous metal treated.

The fact that the sintered mixture comprises not only lime but also a fluxing agent means that its melting point is lower than that of lime and in use the lime is available sooner in a form that assists the desulphurisation. A disadvantage of known mixtures is that lime by itself does not melt at practical iron and steel temperatures and reaction therefore can only occur by liquid-solid surface interactions and these do not favour rapid and effective desulphurisation. Any attempt to overcome this problem by use of higher application rates increases chilling of the metal treated and produces more slag to be disposed of. Furthermore the fact that the lime-flux mixtures used in the present invention are sintered means that they are more readily melted than unsintered mixtures of the same ingredients and are therefore better able to assist the desulphurisation. In cases where the proportion of lime in the sintered mixture is relatively high and that of fluxing agent relatively low, the sintered mixture as a whole may not melt during use of the composition but nevertheless its presence still assists the desulphurisation.

The compositions of the invention enable a high degree of desulphurisation to be achieved and they enable this to be done rapidly and without need for a high application rate of the alkaline earth metal, or the sintered mixture, per tonne of ferrous metal to be treated and without the creation of a large amount of slag.

The compositions of the invention do not have to be made up just before use; instead, they may be made and stored until required for use. Lime not in the form of a sintered mixture has a marked tendency to absorb water and, in view of the reactivity of magnesium towards water, this means that mixtures containing magnesium and lime not in sintered form are a problem to make and/or store. In-line mixing apparatus is not needed in order to use the compositions of the invention.

The use of the sintered mixture in the compositions has a further advantage compared with the use of unsintered materials in that it significantly reduces the amount of dust and fume produced and greatly reduces the rate of water absorption on exposure of the composition to the atmosphere. The latter advantage in turn makes the mixture more free-flowing, and therefore easier to handle, and renders the composition considerably easier to inject into molten metal, the risk of blockage of an injection lance and associated supply equipment being greatly reduced. The low absorption of water also reduces the risk of hydrogen being introduced into the molten metal, with consequent risk of embrittlement of steel.

The following Examples serve to illustrate the invention:

EXAMPLE 1

A mixture of particles of the following ingredients in the percentages given was made and the mixture sintered:

lime: 50% by weight
fluorspar: 30% by weight p0 alumina: 10% by weight
soda ash: 10% by weight A major proportion of the weight of the granular, sintered product obtained consisted of granules having a size of 200 microns or less and not more than 15% of the weight of the granules was of granules of size 75 microns or less.

The sintered granules were mixed with an equal weight of magnesium granules, having sizes in the range of 150 to 850 microns, to form an injectable composition. This composition was injected at a depth of 2 meters into blast furnace iron at a temperature of 1300° C. in a ladle. The composition was injected at a rate of 10 kg/minute and 0.5 kg (0.25 kg magnesium) were injected per tonne of the iron. Thus an injection time of 0.05 minutes per tonne of iron was used.

The sulphur content of the iron before the treatment was 0.026% and after the treatment it was 0.005%. The slag formed was of a fluid nature and easily removed after the treatment.

For comparative purposes, it is noted that in a case where a mixture of lime and magnesium was injected into iron at about 60 kg. lime/minute and about 2.7 kg. magnesium/minute, using about 0.22 kg. magnesium/-tonne of iron, a reduction in sulphur from 0.025% to 0.005% was recorded but an injection time of about 0.08 minutes per tonne of iron treated was needed. Furthermore, much more lime was used than in the above Example of the present nvention, thereby resulting in more chilling and the production of much more slag. In a case where the other conditions were the same but the magnesium injection rate was about 4.6 kg. magnesium/minute instead of about 2.7 kg./minute, a rather longer treatment time was needed to reduce the sulphur content from 0.025% to 0.005% and in this case about 0.39 kg. of magnesium were used per tonne of iron.

EXAMPLE 2

A mixture of sintered granules and magnesium granules as in Example 1 was injected at a depth of 2 meters into blast furnace iron at 1320° C. in a ladle. The mixture was injected at a rate of 16 kg./minute and 0.6 kg. (0.3 kg. magnesium) were injected per tonne of the iron. Thus an injection time of 0.037 minutes per tonne of iron was used.

The sulphur content of the iron was 0.035% before the treatment and 0.010% after the treatment. The slag formed was of a fluid nature and easily removed after the treatment.

We claim:

1. An injectable composition, for desulphurising a molten ferrous metal, comprising an alkaline earth metal and lime, in which the lime is in the form of a sintered mixture of lime and at least one fluxing agent usable with lime to form a desulphurising slag for molten ferrous metals, the mixture of lime and fluxing agent having been sintered at 1100°-1200° C. and then screened, said composition being characterized by a reduced rate of water adsorption on exposure to the atmosphere and consequently improved storage ability in comparison to a corresponding composition wherein the lime is not sintered.

2. A composition according to claim 1 in which the sintered mixture is storable and contains 45 to 95% by weight of lime.

3. A composition according to claim 2 in which the sintered mixture contains not more than 60% by weight of lime.

4. A composition according to claim 1 in which the sintered mixture contains at least one fluxing agent chosen from the group consisting of alumina, alkali and alkaline earth metal fluorides and sodium carbonate.

5. A composition according to claim 2 in which the sintered mixture contains at least 5% by weight of alumina and at least 10% by weight of a fluoride chosen from the group consisting of alkali and alkaline earth metal fluorides.

6. A composition according to claim 1 in which the alkaline earth metal in the composition is magnesium and forms 8 to 60% by weight of the composition.

7. A method of desulphurising a molten ferrous metal by injecting into the metal a composition comprising an alkaline earth metal and lime, in which the lime in the composition is in the form of a sintered mixture of lime and at least one fluxing agent usable with lime to form a desulphurising slag for molten ferrous metals, the mixture of lime and fluxing agent having been sintered at 1100°-1200° C. and then screened, said composition being characterized by a reduced rate of water adsorption on exposure to the atmosphere and consequently improved storage ability in comparison to a corresponding composition wherein the lime is not sintered.

8. A method according to claim 7 in which the composition is injected into the metal at a depth of from 1 to 3 meters.

9. A method according to claim 7 in which the ferrous metal is iron.

10. A method according to claim 9 in which the composition is injected at an application rate corresponding to 0.20 to 0.35 kg. of alkaline earth metal per tonne of the iron using injection time of not more than 0.07 minutes per tonne of the iron and the initial sulphur content of the iron is about 0.03% and is reduced by at least 70%.

* * * * *